US008166932B2

(12) United States Patent
Genta et al.

(10) Patent No.: US 8,166,932 B2
(45) Date of Patent: May 1, 2012

(54) METHOD FOR DETERMINING THE INSTANT WHEN THE MOVABLE ELEMENT OF A SOLENOID VALVE REACHES ITS END POSITION FOLLOWING ENERGIZATION OF THE SOLENOID, BY MEANS OF AN ANALYSIS OF THE SWITCHING FREQUENCE OF THE SOLENOID DRIVING CURRENT

(75) Inventors: Claudio Genta, Orbassano (IT); Claudio Lanfranco, Orbassano (IT); Alberto Manzone, Orbassano (IT); Mitizi Puccio, Orbassano (IT)

(73) Assignee: C.R.F. Società Consortile per Azioni, Orbassano (Turin) (IT)

( * ) Notice: Subject to any disclaimer, the term of this patent is extended or adjusted under 35 U.S.C. 154(b) by 383 days.

(21) Appl. No.: 12/273,320

(22) Filed: Nov. 18, 2008

(65) Prior Publication Data

US 2009/0151667 A1 Jun. 18, 2009

(30) Foreign Application Priority Data

Dec. 18, 2007 (EP) ..... 07425801

(51) Int. Cl.
*F01L 9/04* (2006.01)

(52) U.S. Cl. ..... 123/90.11; 123/90.15; 123/90.52

(58) Field of Classification Search ..... 123/90.11, 123/90.15, 90.48, 90.52, 90.55, 90.44; 137/625.65
See application file for complete search history.

(56) References Cited

U.S. PATENT DOCUMENTS 6,736,092 B2 * 5/2004 Borean et al. ..... 123/90.12
2004/0016461 A1 1/2004 Qu et al.

FOREIGN PATENT DOCUMENTS

| | | | |
|---|---|---|---|
| DE | 42 37 706 | A1 | 5/1994 |
| DE | 43 41 797 | A1 | 6/1995 |
| EP | 0 400 389 | B2 | 10/1996 |
| EP | 1 533 506 | A2 | 5/2005 |
| EP | 1 653 057 | A1 | 5/2006 |
| WO | WO 94/13991 | | 6/1994 |

OTHER PUBLICATIONS

European Search Report for corresponding European Patent Application No. EP 07425801.3-1263.

* cited by examiner

*Primary Examiner* — Zelalem Eshete
(74) *Attorney, Agent, or Firm* — Heslin Rothenberg Farley & Mesiti P.C.; Victor A. Cardona

(57) ABSTRACT

The movable element of a solenoid valve is displaced by means of application to the solenoid of alternating phases at constant voltage and at zero voltage, so as to give rise to an alternation of phases of charging and discharging of the solenoid (switching), corresponding to increases and decreases of current around a substantially constant current value. The alternating phases at constant voltage and at zero voltage are controlled so that the phase at constant voltage is maintained for a pre-set time and the phase at zero voltage is terminated when the decreasing current reaches a pre-set value. Alternatively, it is possible to envisage that the phase at constant voltage will be terminated when the increasing current reaches a pre-set value and the phase at zero voltage is maintained for a pre-set time, or else again that both the phase at constant voltage and the phase at zero voltage will be terminated when the increasing current or decreasing current reaches a pre-set value. In any case, the duration of each cycle of charging and discharging of the solenoid is constantly monitored. It is thus possible to identify the instant at which the movable element of the solenoid valve reaches its end-of-travel position as the instant that separates two successive cycles of charging and discharging of the solenoid having durations that differ from one another by a value higher than a pre-set threshold value.

10 Claims, 1 Drawing Sheet

METHOD FOR DETERMINING THE INSTANT WHEN THE MOVABLE ELEMENT OF A SOLENOID VALVE REACHES ITS END POSITION FOLLOWING ENERGIZATION OF THE SOLENOID, BY MEANS OF AN ANALYSIS OF THE SWITCHING FREQUENCE OF THE SOLENOID DRIVING CURRENT

CROSS REFERENCE TO RELATED APPLICATIONS

This application claims priority from European Patent Application No. 07425801.3 filed on Dec. 18, 2007, the entire disclosure of which is incorporated herein by reference.

BACKGROUND OF THE INVENTION

The present invention relates in general to the control of solenoid valves and regards in particular a method for determining the instant in which the movable element of a solenoid valve reaches the end-of-travel position following upon energization of the solenoid. In a solenoid valve it is possible to displace the movable part having the function of open/close element between two end-of-travel positions corresponding to the open condition and to the closed condition of the valve, through the application of an appropriate profile of driving current to the solenoid.

The method according to the invention is applicable both to normally open solenoid valves, in which said end-of-travel position corresponds to the closed condition of the valve, and to normally closed solenoid valves, in which said end-of-travel position corresponds to the open condition of the valve.

The measurement of the time that elapses between the instant of energization of the solenoid and reaching of the end-of-travel position by the open/close element (activation time) assumes a fundamental importance for the purposes of a robust control of the valve. Said need is, for example, in particular felt in the case of control systems of internal-combustion engines with electro-hydraulic actuation of the intake and/or exhaust valves of the engine. In said applications, it is extremely important to keep under control the times of actuation (understood as times of opening or closing) of the solenoid valves that regulate passage of the oil in the device for actuation of the engine valves.

A particularly important application of the invention is aimed at the electro-hydraulic system for control of the valves of an internal-combustion engine of the type referred to as UNI-AIR, proposed by the present applicant (see, for example EP 1 653 057 A1), in which corresponding to each engine valve there is a pressurized hydraulic chamber that transmits to the engine valve the movement of a tappet actuated by the camshaft of the engine, and in which said pressurized chamber communicates with an exhaust via a normally open solenoid valve. When the solenoid of the solenoid valve is energized, the aforesaid communication is interrupted, and the aforesaid pressurized chamber hydraulically transmits the movements of the actuation cam to the engine valve. When the solenoid is de-energized, the fluid under pressure is discharged from the aforesaid chamber, so as to cause rapid closing of the engine valve as a result of the respective return spring, thus rendering the engine valve independent of its actuation cam.

There have already been proposed methods for determining the instant in which the movable element of a solenoid valve reaches an end-of-travel position (see, for example, the documents Nos. WO-A-9413991 and EP 1 533 506 A2, the latter being filed in the name of the present applicant), where said instant is identified by analysis of the profile of the current and/or of the voltage for supplying the solenoid.

SUMMARY OF THE DESCRIPTION

The purpose of the present invention is to provide a method of the type referred to above that will enable a substantial simplification both of the electronic processing means designed to implement the method itself and the software used thereby and that is moreover intrinsically insensitive (and hence more readily controllable) to the variations of impedance of the circuit for connection of the electronic processing unit to the solenoid, which are due, for example, to the variation of the contact resistance caused by ageing of the connectors or to possible variations of length of the cables.

With a view to achieving the above purpose, the subject of the invention is a method for determining the instant when the movable element of a solenoid valve reaches the end-of-travel position following upon energization of the solenoid:

in which said movable element is displaced by means of application to the solenoid of alternating phases at a constant voltage and at a zero voltage in such a way as to give rise to an alternation of phases of charging and discharging of the solenoid corresponding to increases and decreases of current around a substantially constant current value;

in which the alternating phases at constant voltage and at zero voltage are controlled in such a way that:

each phase at constant voltage is maintained for a fixed time and each phase at zero voltage is terminated when the decreasing current reaches a pre-set value;

or, alternatively, in such a way that:

the phase at constant voltage is terminated when the increasing current arrives at a pre-set value and the phase at zero voltage is maintained for a fixed time;

or, alternatively, in such a way that:

both the phase at constant voltage and the phase at zero voltage are terminated when the increasing current or decreasing current arrives at a pre-set value; and in which the duration of each cycle made up of the aforesaid charging phase and the subsequent discharging phase is constantly monitored and the instant of reaching of the aforesaid end-of-travel position is identified as the instant that separates two successive cycles of charging and discharging that present a difference of duration longer than a pre-set threshold value.

As may be seen, the method according to the invention can be used for detection of the movement of the movable element of the solenoid valve provided that the current that flows through the solenoid is set up through an alternation of phases of charging and discharging (switching) in which at least one of the two steps is performed according to whether a current threshold is reached.

Thanks to the characteristics described above, the method according to the invention enables some substantial advantages to be achieved as compared to the known methods that achieve the same purpose through an analysis of the profile of the current and/or of the voltage for supply of the solenoid. In particular, given the amount of the change of frequency to be detected, it is not necessary to analyse the values of voltage and/or current precisely to arrive at determining the instant of switching. This enables a considerable reduction in the hardware and the software necessary for processing the signal. Furthermore, the system is intrinsically less sensitive (and hence more easily controllable) to the variations of impedance of the circuit for connection to the solenoid, such as, for example, to the variation of resistance of the contacts of the connectors on account of ageing of the latter, and to possible variations in length of the cables or the like.

BRIEF DESCRIPTION OF DRAWINGS

A better understanding of the invention will be obtained with the aid of the annexed plate of drawings, which is provided purely by way of non-limiting example and in which.

DETAILED DESCRIPTION OF THE INVENTION

Figure 1:
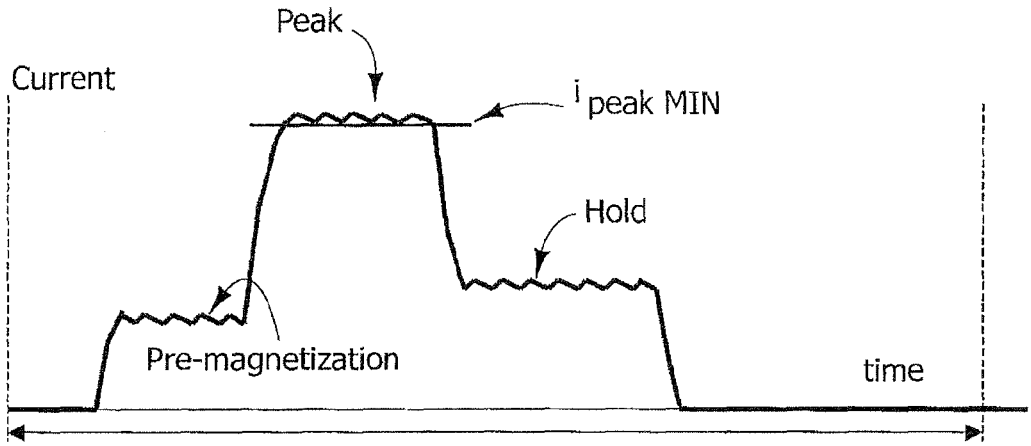
FIG. 1 shows the profile of the solenoid-driving current that brings the movable element of the valve from its first end-of-travel position to its second end-of-travel position and then again to the first end-of-travel position.

Illustrated in FIG. 1 is the variation in time of the current that flows through the solenoid during a complete cycle of energization and de-energization of the solenoid itself, in the specific case of a solenoid valve for control of a system for variable actuation of the valves of an internal-combustion engine, of the UNI-AIR type mentioned above. The profile of the solenoid-driving current is determined across the solenoid by a constant voltage (charging phase), alternating with a zero voltage (discharging phase). In the specific case illustrated, there is envisaged a first level of pre-magnetization current, a second, peak, level, which causes displacement of the movable element of the solenoid valve, and a third, lower, level of hold current, for keeping the movable element in position after it has reached its end-of-travel position.

The levels of current reached depend upon the duration of the phases of charging and discharging. In particular, in order to maintain a constant average level of current, recourse is had to a rapid alternation (switching) between the charging phase and the discharging phase.

In the case illustrated in FIG. 1, in the area of switching around the peak value of the current, the charging phase is performed for a fixed time, whilst the discharging phase is interrupted when a current threshold $i_{piccoMIN}$ is reached.

The movement of the movable element of the solenoid valve, which is obtained as a consequence of the energy supplied by the peak current, causes a variation of inductance, which results in a variation of the voltage across the solenoid. Said phenomenon is known and has already been highlighted in the cited documents Nos. WO-A-9413991 and EP 1 533 506 A2.

Figure 2:
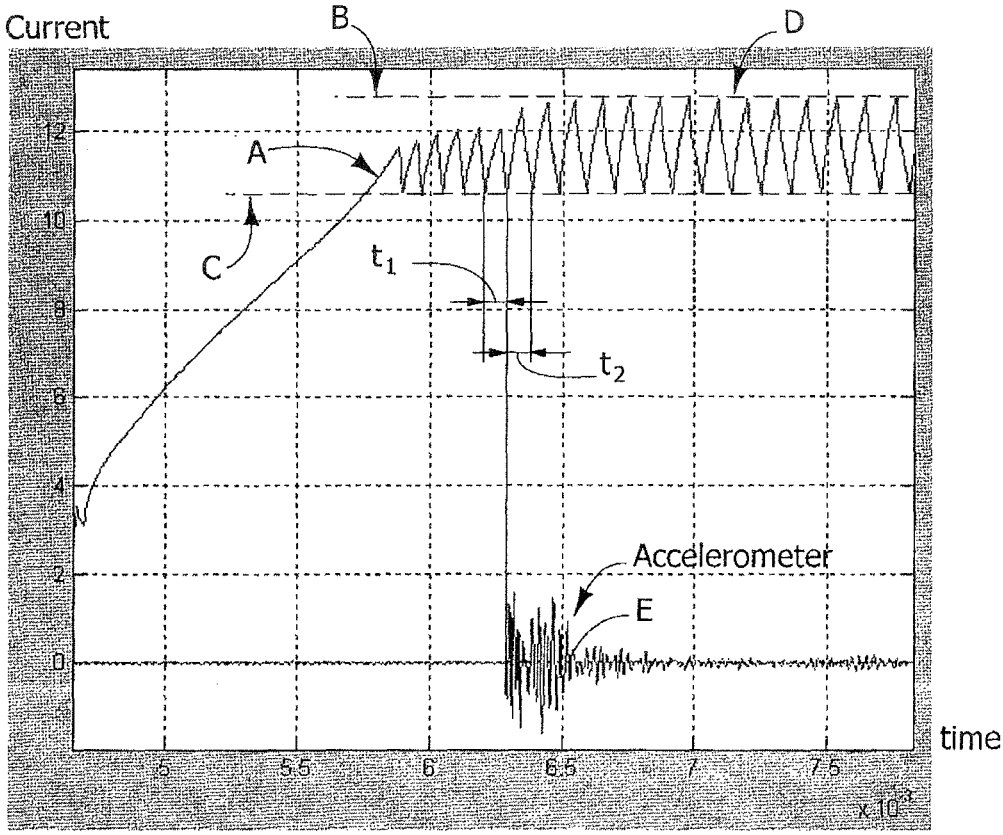
FIG. 2 is a diagram that shows the variation of duration of the cycle of charging and discharging of the solenoid immediately before and after the instant in which the movable element of the valve reaches the end-of-travel position following upon energization of the solenoid.

The aforesaid variation of inductance leads to a consequent variation of the switching frequency, as illustrated in FIG. 2. As may be seen in said figure, since the charging phase is under fixed-time control, the aforesaid phenomenon of variation of the inductance means that, for a first series of cycles designated in FIG. 2 by the reference A, the charging phase terminates when the current has not yet arrived at a maximum value designated by B. Consequently, in the course of the cycles A, the time that the current takes to return to the lower threshold value C is shorter. Instead, in the cycles D in FIG. 2, the current manages to reach the value B in the pre-set time for the charging phase, so that the time that the current takes to return from the maximum value B to the threshold value C becomes longer.

Once again in FIG. 2, the graph E indicates the trace of an accelerometer that has been used experimentally for the purpose of identifying precisely the instant at which the movable element of the solenoid valve reaches its end-of-travel position. As may be seen, immediately prior to said instant the duration of a complete cycle of charging and discharging of the solenoid is equal to a time $t_1$, whilst immediately after the aforesaid instant the duration of a complete cycle of charging and discharging of the solenoid is equal to a time $t_2>t_1$. In practice, in the method according to the invention, the duration t of each cycle of charging and discharging of the solenoid is constantly monitored, and the instant of reaching of the end-of-travel position of the movable element is identified with the instant that divides two successive cycles of charging and discharging, the durations of which differ from one another by a time longer than a pre-set threshold time.

Of course, the same result could be obtained also in the case where the cycles of charging and discharging of the solenoid were to be controlled in such a way that each charging phase is terminated upon reaching of a maximum threshold value of the current and each discharging phase is maintained for a fixed time, or else again in such a way that both the phase at constant voltage and the phase at zero voltage will be terminated when the increasing current or decreasing current reaches a pre-set value.

As has already been mentioned above, thanks to the characteristics that have been described above, the method according to the invention presents advantages as compared to the known methods both from the standpoint of the simplification of the electronic processing means designed to implement the method and from the standpoint of a greater robustness and a more convenient calibration, thanks also to the insensitivity of the system to possible disturbance due, for example, to ageing of the contacts in the connection between the solenoid of the valve and the electronic control unit.

Of course, without prejudice to the principle of the invention, the details of construction and the embodiments may vary widely with respect to what is described and illustrated herein purely by way of example, without thereby departing from the scope of the present invention.

What is claimed is:

1. A method for use in an electro-hydraulic device for variable actuation of the intake and/or exhaust valves of an internal-combustion engine, the method comprising:

the electro-hydraulic device comprising a plurality of engine valves, each engine valve of the plurality of engine valves coupled to a pressurized hydraulic chamber that transmits to the engine valve the movement of a tappet actuated by the camshaft of the engine, and in which said pressurized chamber communicates with an exhaust by means of the solenoid valve;

energizing a solenoid valve by applying a constant voltage to displace a movable element of the solenoid valve to pressurize the pressurized hydraulic chamber;

de-energizing the solenoid valve by applying a zero voltage to displace the movable element of the solenoid valve to de-pressurize the pressurized hydraulic chamber by communicating the chamber with an exhaust to allow a closure of an engine valve of the plurality of engine valves by a spring;

the energizing and de-energizing providing an alternation of phases of charging and discharging of the solenoid corresponding to increases and decreases of current around a substantially constant current value, maintaining each phase at the constant voltage is for a fixed time and terminating each phase at the zero voltage is when the decreasing current reaches a pre-set value; and constantly monitoring the duration of each cycle of a plurality of cycles, each cycle made up of the energizing and the de-energizing;

comparing a duration of at least two cycles of the plurality of cycles to each other and to a pre-set threshold value;

identifying the instant of reaching of the end-of-travel position as being the instant that separates two successive cycles of the plurality of cycles which differ from each other by a duration greater than the pre-set threshold value.

2. The method according to claim 1, wherein the valve comprises a normally closed solenoid valve for determining the instant at which the movable element of the solenoid valve reaches its end-of-travel position corresponding to the open condition of the valve.

3. The method according to claim 1, wherein the valve comprises a normally open solenoid valve for determining the instant at which the movable element of the solenoid valve reaches its end-of-travel position corresponding to the closed condition of the valve.

4. A method for determining an instant when a movable element of a solenoid valve reaches an end-of-travel position following upon energization of the solenoid, the method comprising:

said movable element displaced by application to the solenoid of alternating phases at a constant voltage and at a zero voltage in such a way as to give rise to an alternation of phases of charging and discharging of the solenoid corresponding to increases and decreases of current around a substantially constant current value, in which the alternating phases at constant voltage and at zero voltage are controlled in such a way that:

the phase at constant voltage is terminated when the increasing current reaches a pre-set value and the phase at zero voltage is maintained for a fixed time; and in which the duration of each cycle made up of the aforesaid charging phase and the subsequent discharging phase is constantly monitored and the instant of reaching of the aforesaid end-of-travel position is identified as the instant that separates two successive cycles of charging and discharging that present a difference of duration greater than a pre-set threshold value wherein the solenoid valve is used in an electro-hydraulic device for variable actuation of the intake and/or exhaust valves of an internal-combustion engine; and said electro-hydraulic device comprising a plurality of engine valves, each engine valve of the plurality of engine valves coupled to a pressurized hydraulic chamber that transmits to the engine valve the movement of a tappet actuated by the camshaft of the engine, and in which said pressurized chamber communicates with an exhaust by means of the solenoid valve, so that, when said communication is established, there is brought about rapid closing of the engine valve as a result of the respective return spring, thus rendering the engine valve independent of its actuation cam.

5. The method according to claim 4, wherein the valve comprises a normally closed solenoid valve for determining the instant at which the movable element of the solenoid valve reaches its end-of-travel position corresponding to the open condition of the valve.

6. The method according to claim 4, wherein the valve comprises a normally open solenoid valve for determining the instant at which the movable element of the solenoid valve reaches its end-of-travel position corresponding to the closed condition of the valve.

7. A method for determining an instant when a movable element of a solenoid valve reaches an end-of-travel position following upon energization of the solenoid, the method comprising:

said movable element displaced by application to the solenoid of alternating phases at a constant voltage and at a zero voltage in such a way as to give rise to an alternation of phases of charging and discharging of the solenoid corresponding to increases and decreases of current around a substantially constant current value, in which the alternating phases at constant voltage and at zero voltage are controlled in such a way that:

both the phase at constant voltage and the phase at zero voltage are terminated when the increasing current or decreasing current reaches a pre-set value; and in which the duration of each cycle of a plurality of cycles, each cycle made up of the aforesaid charging phase and the subsequent discharging phase is constantly monitored, a duration of at least two cycles of the plurality of cycles are compared to each other and to a pre-set threshold value, and an instant of reaching of the aforesaid end-of-travel position is identified as the instant that separates two successive cycles of the plurality of cycles which differ from each other by a duration greater than the pre-set threshold value;

wherein the solenoid valve is used in an electro-hydraulic device for variable actuation of the intake and/or exhaust valves of an internal-combustion engine;

said electro-hydraulic device comprising a plurality of engine valves, each engine valve of the plurality of engine valves coupled to a pressurized hydraulic chamber that transmits to the engine valve the movement of a tappet actuated by the camshaft of the engine, and in which said pressurized chamber communicates with an exhaust by means of the solenoid valve, so that, when said communication is established, there is brought about rapid closing of the engine valve as a result of the respective return spring, thus rendering the engine valve independent of its actuation cam.

8. The method according to claim 7, wherein the valve comprises a normally closed solenoid valve for determining the instant at which the movable element of the solenoid valve reaches its end-of-travel position corresponding to the open condition of the valve.

9. The method according to claim 7, wherein the valve comprises a normally open solenoid valve for determining the instant at which the movable element of the solenoid valve reaches its end-of-travel position corresponding to the closed condition of the valve.

10. An electro-hydraulic device for variable actuation of the intake and/or exhaust valves of an internal-combustion engine, the device comprising:

a pressurized hydraulic chamber that transmits to an engine valve the movement of a tappet actuated by the camshaft of the engine and in which said pressurized chamber communicates with a discharge by means by a solenoid valve, so that, when said communication is established, a rapid closing of the engine valve takes place due to a respective return spring, thus rendering the engine valve independent of its actuation cam, said device comprising means for controlling said solenoid valve, said means for controlling the solenoid valve configured to determine the instant when the movable element of a solenoid valve reaches the end-of-travel position following upon energization of the solenoid, said means for controlling the solenoid valve being such that:

said movable element is displaced by means of application to the solenoid of alternating phases at a constant voltage and at a zero voltage in such a way as to give rise to an alternation of phases of charging and discharging of the solenoid corresponding to increases and decreases of current around a substantially constant current value, the alternating phases at constant voltage and at zero voltage are controlled in such a way that:

each phase at constant voltage is maintained for a fixed time and each phase at zero voltage is terminated when the decreasing current reaches a pre-set value; or in such a way that:

the phase at constant voltage is terminated when the increasing current reaches a pre-set value and the phase at zero voltage is maintained for a fixed time;

the duration of each cycle of a plurality of cycles made up of the charging phase and the subsequent discharging phase is constantly monitored, a duration of at least two cycles of the plurality of cycles are compared to each other and to a pre-set threshold value, and an instant of reaching of the end-of-travel position is identified as the instant that separate two successive cycles of the plurality of cycles which differ from each other a duration greater than the pre-set threshold value.

* * * * *